United States Patent [19]

Fujita

[11] 3,942,318

[45] *Mar. 9, 1976

[54] TIME CORRECTION DEVICE FOR DIGITAL INDICATION ELECTRONIC WATCH

[75] Inventor: Kinji Fujita, Shimosuwa, Japan

[73] Assignee: Kabushiki Kaisha Suwa Seikosha, Tokyo, Japan

[ * ] Notice: The portion of the term of this patent subsequent to Mar. 5, 1991, has been disclaimed.

[22] Filed: Mar. 4, 1974

[21] Appl. No.: 447,699

Related U.S. Application Data

[62] Division of Ser. No. 204,064, Dec. 2, 1971, Pat. No. 3,795,098.

[30] Foreign Application Priority Data

Dec. 3, 1970 Japan ..... 45-106454

[52] U.S. Cl. ..... 58/85.5; 58/23 R; 58/50 R

[51] Int. Cl.[2] ..... G04B 27/00

[58] Field of Search ..... 58/23 R, 50 R, 85.5, 33

[56] References Cited

UNITED STATES PATENTS

| | | | |
|---|---|---|---|
| 3,596,462 | 8/1971 | Hayes | 58/50 R |
| 3,668,859 | 6/1972 | Polin et al. | 58/23 R |
| 3,672,155 | 6/1972 | Bergey et al. | 58/50 R |
| 3,678,680 | 7/1972 | Fujita | 58/23 R |
| 3,707,071 | 12/1972 | Walton | 58/23 A |
| 3,742,698 | 7/1973 | Naito | 58/23 A |
| 3,795,098 | 3/1974 | Fujita | 58/85.5 |

*Primary Examiner*—L. T. Hix
*Assistant Examiner*—U. Weldon
*Attorney, Agent, or Firm*—Blum, Moscovitz, Friedman & Kaplan

[57] ABSTRACT

A digital indication electronic wristwatch having a liquid crystal display panel driven by the output of a standard oscillator through frequency divider circuitry. Time regulation is provided by means of a first switch for resetting the entire frequency dividing circuit and a second switch for individually resetting that portion of the frequency divider circuit whose output corresponds to a 1-second or 1-minute signal. If desired, further switches may be provided for individually resetting those portions of the frequency divider circuit whose output corresponds respectively to the 10-second, 10-minute or 1-hour signal.

2 Claims, 3 Drawing Figures

TIME CORRECTION DEVICE FOR DIGITAL INDICATION ELECTRONIC WATCH

CROSS REFERENCE TO RELATED APPLICATION

This is a division of my co-pending application Ser. No. 204,064, filed Dec. 2, 1971 now U.S. Pat. No. 3,795,098 issued Mar. 5, 1974.

BACKGROUND OF THE INVENTION

This application relates to a device for effecting time correction and regulation in digital indication electronic wristwatches utilizing liquid crystal displays. In the art, such watches have generally been provided with correction devices which are far inferior to the correction devices incorporated in mechanical watches, when the ease of time correction is considered, or not provided with such time correction devices at all. Regulation was generally performed by providing a device which permitted only the resetting of the display of the watch as a unit, in other words, the resetting of the display back to the zero second, zero minute, zero hour position.

SUMMARY OF THE INVENTION

Generally speaking, in accordance with the invention, a digital indication electronic wristwatch is provided having standard high frequency oscillator means, frequency divider circuit means coupled to said oscillator means for dividing the frequency output thereof into time indication signals, liquid crystal display means, means for applying said time indication signals to said liquid crystal display means for the digital display of time, and time regulation means including first switch means for resetting said frequency divider circuit means as a unit, and second switch means coupled to the portion of said frequency divider circuits producing a 1-second or 1-minute signal for resetting said individual portion. Further switch means may be provided for individually correcting each of the portions of said frequency divider circuit means producing the 10-second, 10-minute and 1-hour signals.

Accordingly, it is an object of this invention to provide a time correction and regulation device for digital indication electronic wristwatches which permits time correction and regulation to be easily and accurately performed by anyone, without the need for special skills.

Still other objects and advantages of the invention will in part be obvious and will in part be apparent from the specifications and drawings.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
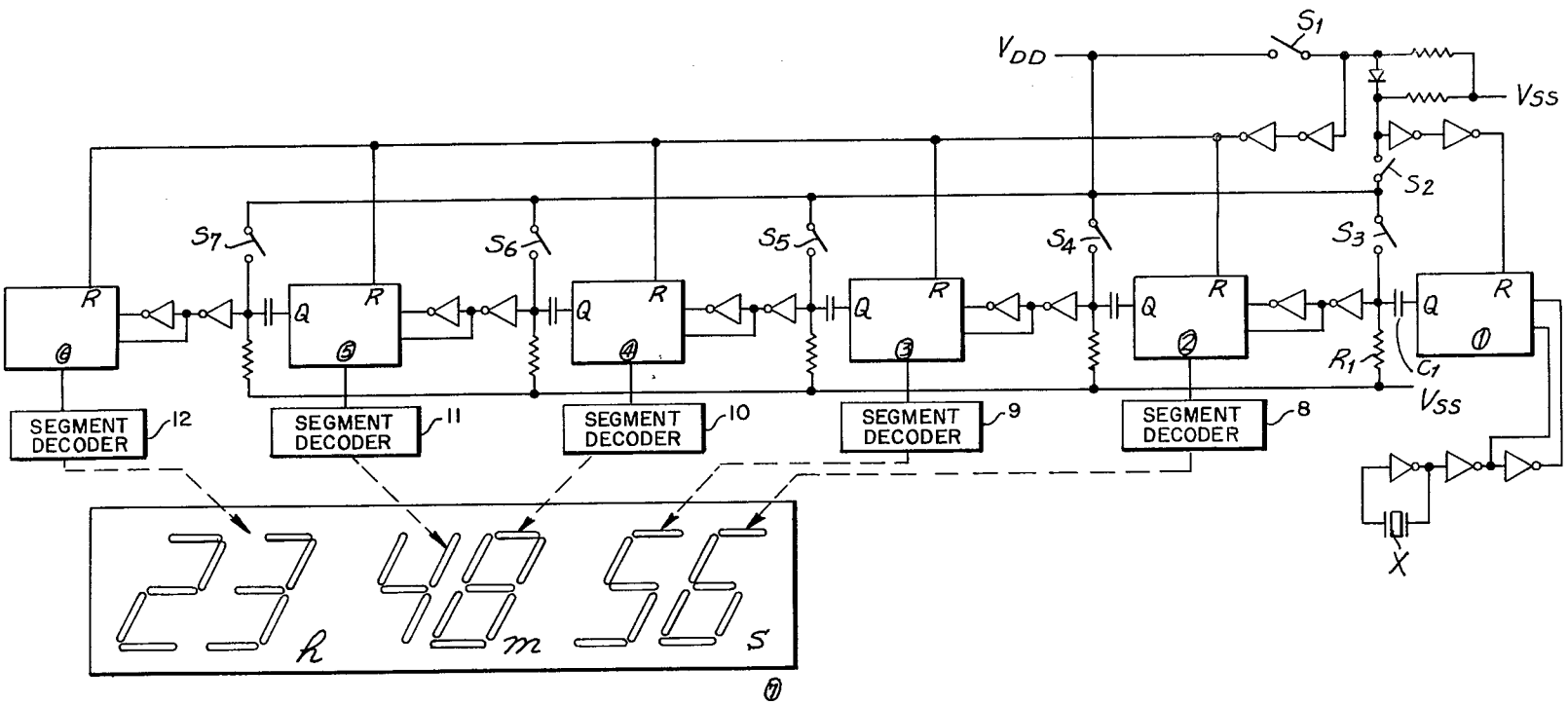
FIG. 1 is a block diagram of the digital indication electronic timepiece incorporating a time correction device according to the invention.

Referring now to FIG. 1, a block diagram of one embodiment of a digital indication electronic watch provided with a time correction and regulation device is depicted. In said block diagram, X refers to a time standard crystal oscillator, the frequency of which is generally selected at $2^n$so as to permit efficient frequency division. The output signal of said crystal oscillator is amplified and reversed in phase by an inverter and applied to a ripple carry counter 1 formed from metal oxide semi-conductor transistors arranged in complimentary-symmetry configurations, and hereinafter referred to as "COS/MOS transistors".

Figure 2:
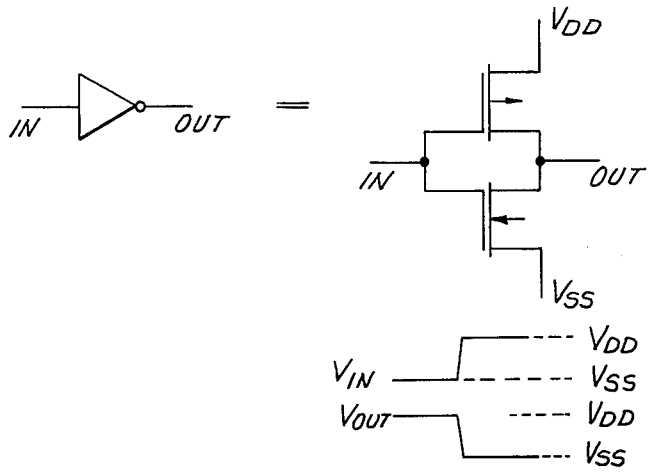
FIG. 2 is a circuit diagram of a COS/MOS inverter according to the invention.

A circuit diagram of an inverter formed of COS/MOS transistors and the input and output wave forms thereof is depicted in FIG. 2. Said inverter circuit is formed of a pair of MOS transistors aligned in the complimentary-symmetry configuration.

Figure 3:
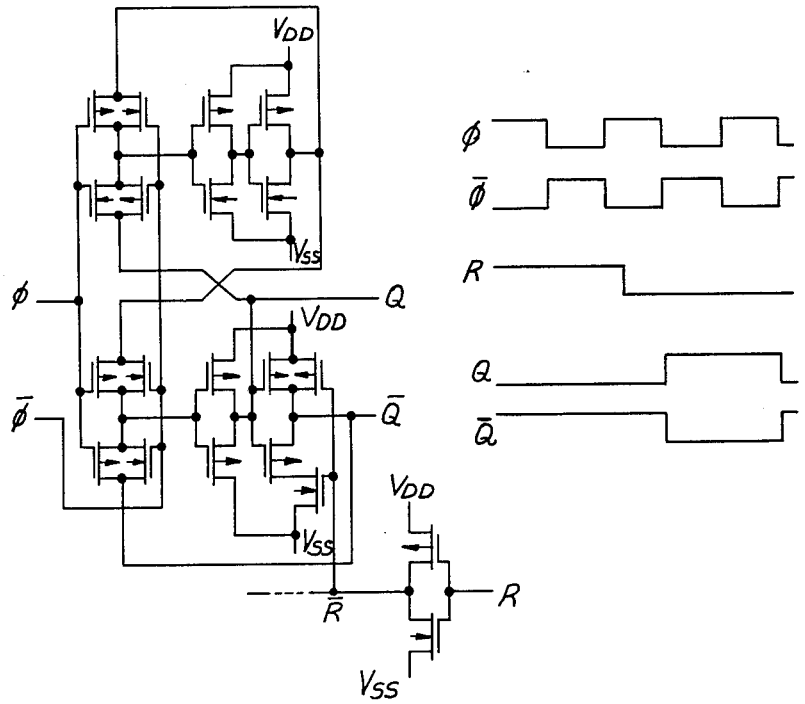
FIG. 3 is a COS/MOS ripple carry counter according to the invention.

Referring now to FIG. 3, a circuit diagram and input and output wave forms of one step of the ripple carry binary counter 1 are depicted. Said counter begins counting when the voltage on the reset terminal R is low and is reset when the voltage on reset terminal R is high. The input signals, taken from the crystal oscillator and inverters are applied to terminals $\phi$ and $\overline{\phi}$ while the outputs at each step are taken at terminals Q and $\overline{Q}$.

Referring again to FIG. 1, ripple carry counter 1 has n steps and produces a 1-second signal at output terminal Q which is applied to the next frequency dividing step. Circuit network 2 includes a decade counter and a segment decoder, and is adapted to produce a 10-second signal from the 1-second signal, while at the same time, producing the 1 -second timing signals which are applied through a segment decoder 8 to operate the seconds units digit of the liquid crystal display panel 7. Said seconds units digit, as well as the other digits of the liquid crystal display panel each consist of a 7 bar display, said segment decoder serving to excite the appropriate segments for display of the required number from zero to 9. Said segment decoder operates in the same manner as the "0-9 DECODER" described in U.S. Pat. No. 3,576,099, which issued to Richard S. Walton on Apr. 27, 1971, except that the logic circuitry of segment decoder 11 would produce a seven element output code for driving the seven bar display 7 rather than the thirteen-element output code required for the thirteen-point display of U.S. Pat. No. 3,576,099, in a manner well known in the art.

Circuit networks 3 and 5 each consist of a 1/6 frequency divider. Circuit network 3 is coupled to the seconds tens digit of the liquid crystal display panel through segment decoder 9 while circuit network 5 is connected to the minutes tens digit of the liquid crystal display panel through segment decoder 11. Circuit network 4 includes a decade counter and is coupled to the minutes units digit of said display panel through segment decoder 10. Finally, circuit network 6 includes a 1/24 frequency divider, and is coupled to the hour digits of the liquid crystal display panel through segment decoder 12.

Circuit networks 1, 2, 3, 4, 5 and 6 are connected in series, a capacitor and a pair of inverters being connected in series between each adjacent network pairs.

Regulation of the circuit of FIG. 1 is effected, in the first instance, by a switch $S_1$, which, when closed, resets all of the circuit networks 1, 2, 3, 4, 5 and 6. The resetting voltage is applied through the diode and inverters. Thus, in effect, the opening and closing of switch $S_1$ permits the use of the watch as a stopwatch. However, where the watch is to be utilized for ordinary purposes, the switch $S_1$would permit the setting of the watch only once a day at 24 o'clock, an arrangement which is completely inconvenient.

The foregoing deficiency is eliminated by the provision of switch $S_2$, which permits the separate resetting of circuit network 1, so that the time indication can be set at the proper time at any time of the day. Where the liquid display panel setter is provided with only an hours and minutes display, resetting at the correct time once a minute is made possible by positioning switch $S_2$so that it is capable of simultaneously resetting circuit networks 1, 2 and 3.

Complete time correction is achieved by means of switches $S_3$, $S_4$, $S_5$, $S_6$ and $S_7$. Taking switch $S_3$ as an example, the operation of each of said switches is explained as follows. Since the DC portion of the output signal is cut by capacitor $C_1$, the input of the inverter which drives circuit network 2 is maintained at "low" (voltage=$V_{ss}$) by the resistance $R_1$except during the transition period when the output signal is reversed. For this reason, when the switch $S_3$ is turned on, a high voltage ($V_{DD}$) is applied at the input signal of the inverter which in turn applies a suitable input signal to circuit network 2. Thus, for each close-open cycle of switch $S_3$, a signal is applied to circuit network 2, by means of which the indication at the corresponding seconds units digit may be corrected.

By the same principal, each unit of indication may be individually corrected by means of the switches $S_4$, $S_5$, $S_6$ and $S_7$. Such correction can be effected rapidly and precisely both when the electric power source is first applied, and during normal use, when the time indication of the watch is incorrect.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a digital indication electronic wristwatch comprising standard high frequency oscillator means; frequency divider circuit means coupled to said oscillator means for dividing the frequency output thereof into time indication signals, said frequency divider circuit means being formed of COS/MOS circuit elements and including a plurality of series connected stages, said divider stages being adapted to each advance in count by one upon the application of each pulse to the input thereof, the count of each of a plurality of said divider stages producing time indication signals representative of a digit of time; digital display means adapted for the digital display of said digits of time; means coupled to said frequency divider circuit means for receiving said time indication signals therefrom and to said display means for applying said time indication signals representative of digits of time to corresponding digits of said display means for driving said display means; and time correction means including a source of d.c. voltage, a manually operable time correction switch and means connecting said switch in series with said d.c. voltage source and the input of one stage of said frequency divider circuit means associated with at least one digit of time display of said display means so that said switch is positioned between said d.c. voltage source and said input of said one stage of said frequency divider circuit and so that said switch is out of the series connection of said divider stages, said switch controlling the application of said d.c. voltage to the input of said one stage to apply a pulse to said one stage for each manual operation of said switch for advancing the count of said stage by one for each manual operation of said switch without opening the circuit between said one stage and the stage in advance of said one stage, so that the associated digit of time advanced by one for each manual operation of said switch is displayed on said display means.

2. A digital indication electronic wristwatch as recited in claim 1, wherein said d.c. voltage source is a source of a high potential, said time correction means including capacitor means connected in the series connection of said divider stages at a position between the output of the stage in advance of said one stage and said one stage, said switch being connected to the input of said one stage through a point in the series connection of said divider stages located between said capacitor means and said input of one stage, a source of a low potential, and resistor means connected between said low potential source and said point in said series connection.

* * * * *